United States Patent [19]

Leather

[11] 4,331,376

[45] May 25, 1982

[54] ELECTRIC CONNECTORS

[75] Inventor: Russell A. Leather, Perth, Scotland

[73] Assignee: Ferranti Limited, Cheshire, England

[21] Appl. No.: 140,682

[22] Filed: Apr. 16, 1980

Related U.S. Application Data

[63] Continuation of Ser. No. 29,343, Apr. 12, 1979, abandoned, which is a continuation of Ser. No. 895,971, Apr. 13, 1978, abandoned.

[30] Foreign Application Priority Data

Apr. 16, 1977 [GB] United Kingdom ..... 15879/77

[51] Int. Cl.[3] ..... H01R 13/12

[52] U.S. Cl. ..... 339/258 R

[58] Field of Search ..... 339/258 R, 258 C, 258 F, 339/258 P

[56] References Cited

U.S. PATENT DOCUMENTS

| | | | |
|---|---|---|---|
| 3,566,341 | 2/1971 | Skony | 339/258 P |
| 3,566,344 | 2/1971 | Teagno et al. | 339/258 P |
| 3,853,389 | 12/1974 | Occhipinti | 339/258 R |
| 4,076,369 | 2/1978 | Ostapovitch | 339/258 R |

FOREIGN PATENT DOCUMENTS

| | | | |
|---|---|---|---|
| 335324 | 2/1959 | Switzerland | 339/258 R |
| 611497 | 10/1948 | United Kingdom | 339/258 R |
| 1100657 | 1/1968 | United Kingdom | 339/258 R |

*Primary Examiner*—Joseph H. McGlynn

*Attorney, Agent, or Firm*—Kerkam, Stowell, Kondracki & Clarke

[57] ABSTRACT

An electric connector includes a housing having a number of elongated recesses, and a plurality of contacts. Each contact has a terminal portion, two spaced parallel support members extending between the terminal portion and a web, and two contact members located between the support members and extending one from the terminal member and one from the web.

6 Claims, 5 Drawing Figures

ELECTRIC CONNECTORS

This application is a continuation of Ser. No. 29,343, filed Apr. 12, 1979, now abandoned, which is a continuation of Ser. No. 895,971, filed Apr. 13, 1978, now abandoned.

This invention relates to electric connectors, and in particular to contacts for insertion into a recess in a housing to form part of an electric connector.

Many types of socket contact for electric connectors are known which are designed to fit into open-ended recesses of rectangular cross-section in insulated housings. Such connectors may have one or more contacts, each located in a separate recess. Various means are employed for retaining the contacts in position in the housing. Many contacts designed for this purpose are contacts which are made to conform with three or four sides of the recess in the housing, and may conveniently be referred to as "box" contacts. The formation of such contacts from a flat strip requires several bending operations since bends have to be made in different planes. Such constructions also make it difficult to plate only the contact surfaces with a precious metal such as gold.

It is an object of the invention to provide an electric connector having contacts which do not suffer from the abovementioned disadvantages.

According to the present invention there is provided an electric connector which includes a housing containing at least one elongated recess of rectangular cross-section with an aperture at one end through which a co-operating plug member may be inserted and at least one electric contact, the contact comprising a terminal member arranged to extend out of the housing, a pair of spaced parallel support members each attached at one end to the terminal member and joined at the other end by a web, and a pair of contact members arranged in line with one another between and parallel to the support members and each extending from a separate bridge between the two support members towards one another, the contact being shaped so that the support members conform with the said one end and two opposite sides of the recess in the housing with the contact members biased towards one another at their free ends.

Preferably the contact includes a tongue extending from the web such that the tongue conforms with an end of the recess opposite to said one end and makes good electrical contact with the terminal member.

The two bridges preferably coincide one with the terminal member and one with the web such that the contact members extend towards one another one from the terminal member and the other from the web.

A plurality of contacts may be formed simultaneously whilst attached to a common linking strip.

The invention, will now be described with reference to the accompanying drawings, in which.

Figure 1:
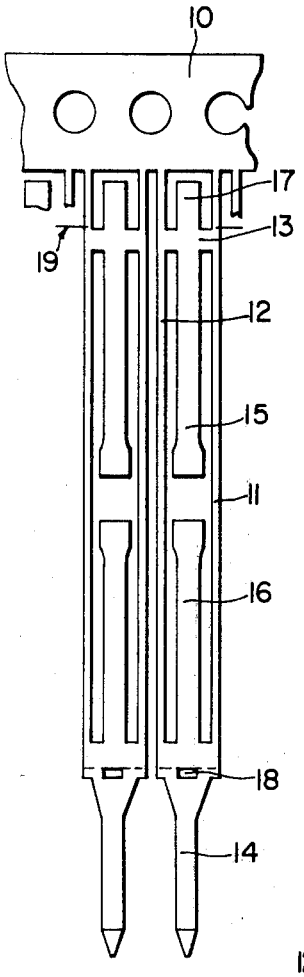
FIG. 1 is a plan view of two contacts attached to a linking strip.

Referring now to FIG. 1, this illustrates not only the shape of a contact but also one way in which contacts may be formed. As shown in the drawing the contacts are stamped out of a strip of material such as phosphor-bronze, leaving each contact attached at one end to a continuous linking strip 10. Each of the two contacts shown in FIG. 1 is initially flat and comprises a pair of spaced parallel support members 11 and 12 extending from the strip 10. The two support members are joined at their ends nearest the strip 10 by a web 13, and at their ends furthest from the strip 10 by a terminal member in the form of a pin or post 14. A pair of contact members 15 and 16 are provided, extending towards one another between the two support members 11 and 12, one of the contact members extending from the web 13 and the other extending from the terminal member 14. A tongue 17 also extends from the web 13, towards the strip 10. The base of the terminal member 14 carries an aperture 18 of such dimensions that the tongue 17 may be received in it as a force fit.

Figure 2:
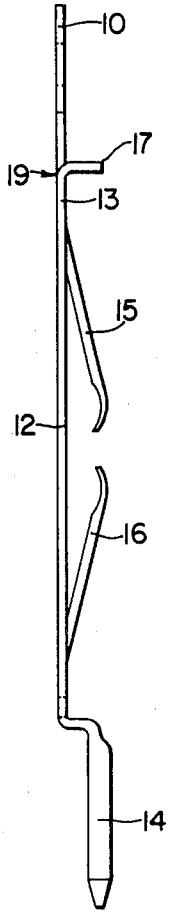
FIG. 2 is a side view of one contact of FIG. 1.

Subsequent to the stamping operation which forms the contact as in FIG. 1, a coining operation is carried out which shapes the contact members 15 and 16 and the tongue 17 into the form shown in FIG. 2. The two contact members are formed into a shape which will provide the necessary spring rate characteristics, whilst the free ends of the contact members are shaped to provide contact surfaces. The tongue 17 is bent at right angles to the web 13. In addition the terminal member 14 is shaped as shown, being bent away from, but parallel to, the line of the support members 11 and 12. The free ends of the contact members 15 and 16 are then plated with a precious metal such as gold.

Figure 3:
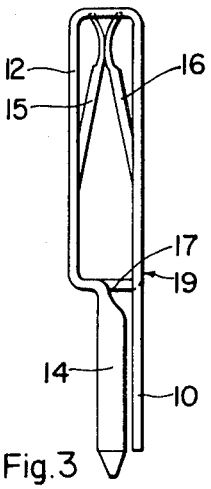
FIG. 3 is a side view of a shaped contact.

After the coining and plating operations, but whilst still attached to the strip 10, the contact is folded into the shape shown in FIG. 2. The two support members 15 and 16 are folded back on themselves in the centre so that the two contact members face one another on opposite sides of a rectangular "box" formed by the contact. The folding is such that the tongue 17 enters the aperture 18 in which it is a force fit. The two contact members 15 and 16 preferably touch one another as shown. At this stage the contacts are still attached to the strip 10, and they may be separated from it by shearing off the support members below the web 13, that is along the line 19 in FIGS. 1, 2 and 3. To assist shearing the strip may be weakened by chiselling along line 19 during the forming operations.

Figure 4:
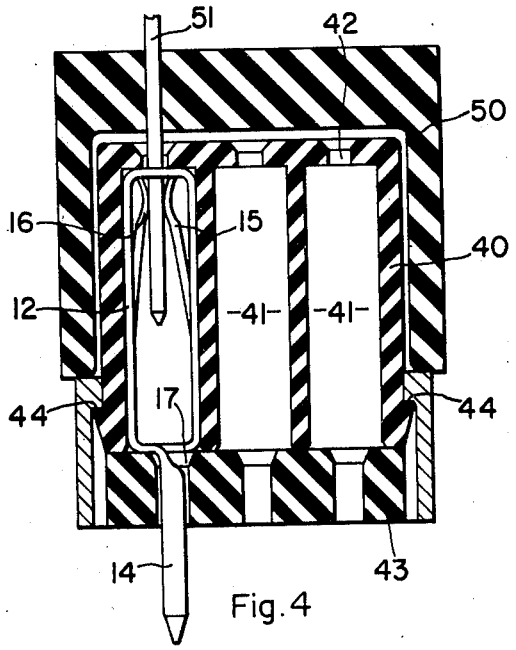
FIGS. 4 and 5 are partially sectioned side views of a shaped contact inserted into a housing.
Figure 5:
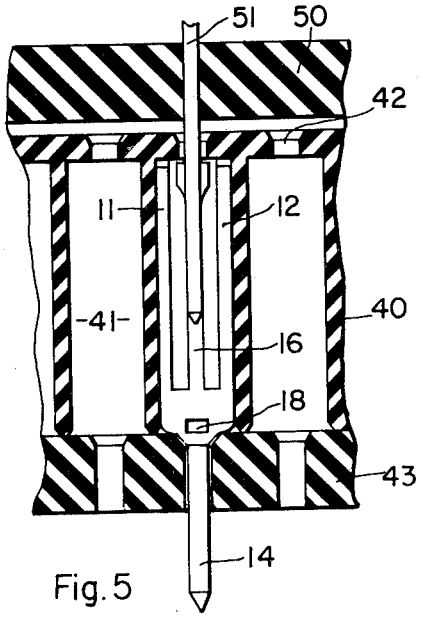

FIGS. 4 and 5 show a contact inserted into its housing. The housing is made up from two mouldings of electrically-insulating material. The body member 40 of the housing contains a number of recesses 41 of rectangular cross-section. Each recess has an aperture 42 at one end through which a co-operating plug member may be inserted. The shaped contact conforms to the shape of the recess, the support members 11 and 12 fitting closely against two sides of the recess and the end having apertures 42 formed in it. The tongue 17 crosses the open end of the recess. When the contacts have been inserted into the body member 40, they are retained in position by a base member 43 which is held in position by suitable means, such as the co-operating surfaces 44 shown in FIG. 4. The base member 43 is formed with apertures through which the terminal members 14 pass as shown.

Also shown in FIGS. 4 and 5 is a plug comprising a moulding 50 carrying pins 51, each in a position to pass through a separate aperture 42 in the body member 40 of the socket. As shown in FIG. 5 the pin passes between the contact members 15 and 16, and makes contact with both. The tongue 17 carries current directly from the terminal member 14 to the contact member 15, so that it is not necessary for current to flow along the support members 11 and 12. However, the tongue 17 and its co-operating aperture 18 may be omitted.

The embodiment described above has the two contact members 15 and 16 extending respectively from the web 13 and the terminal member 14. However, it is possible to modify the form of the contact by joining the two support members 11 and 12 by a pair of bridges, similar in form to the web 13, but each located nearer to the centre of the members then are the web 13 and terminal member 14, and using these bridges to support the contact members.

Contacts of the type described in either of the above embodiments may be assembled mechanically if the remain attached to the strip 10 until inserted into the body member 40, at which time the strip is sheared from the contact. The spacing between the contacts whilst attached to the strip should in this case be the same as the spacing betwen the recesses in the housing.

What I claim is:

1. An electric connector which includes a housing containing at least one elongated recess of rectangular cross-section with an aperture at one end through which a cooperating plug member may be inserted, and at least one electric contact for insertion into said recess, the contact comprising a terminal member arranged to extend out of the opposite end of the recess, a pair of spaced parallel support members extending from the terminal member and joined at the other end by a web, a pair of contact members arranged in line with one another between the pair of support members and each extending from a separate bridge between the two support members, a tongue extending from one of the members of the group comprising the terminal member and the web, and a cooperating aperture formed in the other member of the group, the contact being so shaped that the support members fit closely along the said one end and the two opposite sides of the recess in the housing with the contact members biased towards one another at their free ends with the tongue fitting across the aperture at the said opposite end of the recess and engaging the said cooperating aperture in the contact so as to form a good electrical connection between the web and the terminal member.

2. A connector as claimed in claim 1 in which the two bridges of the contact coincide one with the terminal member and one with the web such that the contact members extend towards one another one from the terminal member and the other from the web.

3. A connector as claimed in claim 1 in which a plurality of contacts are formed simultaneously whilst attached to a common linking strip.

4. A connector as claimed in claim 2 in which the spacing between adjacent contacts whilst attached to the linking strip is the same as the spacing between adjacent recesses in the housing.

5. A contact for insertion into a recess in a housing to form part of an electric connector which includes a terminal member, a pair of spaced parallel support members each attached at one end to the terminal member and joined at the other end by a web, the distance between the outer edges of the support members being equal to the width of the recess in the housing into which the contact is to be inserted, a pair of contact members arranged in line with one another between the pair of support members and each extending from a separate bridge between the pair of support members, a tongue extending from one of the members of the group comprising the terminal member and the web, and a cooperating aperture formed in the other member of the group, with the tongue fitting across the aperture at the said opposite end of the recess and engaging the said cooperating aperture in the contact so as to form a good electrical connection between the web and the terminal member.

6. A contact as claimed in claim 5 in which the two bridges coincide one with the terminal member and one with the web.

* * * * *